US007946459B1

(12) United States Patent
Cheitman

(10) Patent No.: US 7,946,459 B1
(45) Date of Patent: May 24, 2011

(54) SAFETY-ENHANCING ADORNMENT DEVICE FOR A PERSONAL ALARM OR REMOTE CONTROL DEVICE

(76) Inventor: Edith Anne Cheitman, Sarasota, FL (US)

( * ) Notice: Subject to any disclaimer, the term of this patent is extended or adjusted under 35 U.S.C. 154(b) by 0 days.

(21) Appl. No.: 12/831,800

(22) Filed: Jul. 7, 2010

Related U.S. Application Data

(63) Continuation-in-part of application No. 12/381,824, filed on Mar. 16, 2009, now abandoned.

(60) Provisional application No. 61/036,547, filed on Mar. 14, 2008.

(51) Int. Cl.

| | |
|---|---|
| ***A45F 5/00*** | (2006.01) |
| ***A45C 13/30*** | (2006.01) |
| ***A45C 15/00*** | (2006.01) |
| ***B65D 85/38*** | (2006.01) |
| ***B65D 83/04*** | (2006.01) |

(52) U.S. Cl. ..... 224/600; 224/601; 224/602; 224/603; 224/604; 224/623; 224/250; 224/930; 63/1.18; 206/320; 206/37; 455/100

(58) Field of Classification Search ..... None
See application file for complete search history.

(56) References Cited

U.S. PATENT DOCUMENTS

| | | | | |
|---|---|---|---|---|
| 4,824,059 | A * | 4/1989 | Butler | 248/176.1 |
| 5,388,691 | A | 2/1995 | White | |
| 5,388,692 | A * | 2/1995 | Withrow et al. | 206/320 |
| 2002/0175096 | A1 | 11/2002 | Linihan | |
| 2009/0321291 | A1 * | 12/2009 | Asla | 206/320 |

* cited by examiner

*Primary Examiner* — Jack W. Lavinder
(74) *Attorney, Agent, or Firm* — Dorothy S. Morse

(57) ABSTRACT

A simple-to-use adornment device, and method, employed by a user close-at-hand for personal safety enhancement. It contains a personal alarm or remote control device while maintaining a capability for immediate alarm/remote activation to summon assistance. It has a jewelry appearance or comprises a modular casing to which exchangeable decorative elements can be attached. Since it improves the aesthetic look of an associated alarm/remote, users are more likely to wear it habitually and experience enhanced personal safety and well-being as a result thereof. Inner and outer members with asymmetrical keyed guides are in sliding relation to one another to form the casing with one-way assembly, and a cord/chain connected to the members maintains their association with one another even when disassembled. Openings in each member are aligned to provide activation button access. Optional features include an interior resilient spacer, a cover, a clasp, and sheet pockets associated with the outer member.

20 Claims, 10 Drawing Sheets

SAFETY-ENHANCING ADORNMENT DEVICE FOR A PERSONAL ALARM OR REMOTE CONTROL DEVICE

CROSS-REFERENCES TO RELATED APPLICATIONS

This application is a Continuation-in-Part of U.S. non-provisional patent application Ser. No. 12/381,824 to the same inventor that was filed on Mar. 16, 2009 now abandoned under the title of "Adornment Device for Personal Alarms and Remote Control Devices", which had been previously given domestic priority to U.S. provisional patent application filed on Mar. 14, 2008, by the same inventor herein, that had the application number of 61/036,547 and the title of "Personal Alarm and Remote Adornment Device". Thus, the applicant herein respectfully requests for the present invention all possible domestic priority benefit resulting from her two above-referenced U.S. patent application Ser. Nos. 12/381,824 and 61/036,547.

BACKGROUND

1. Field of the Invention

This invention relates to the field of necklaces, bracelets, and other forms of jewelry-like decorative devices worn by a person, secured to their clothing, or used on fashion accessories and other items held in close association with a user, specifically to an adornment device (amulet or jewelry), and method for its use, that is maintained close-at-hand by a user for enhanced personal safety and which is configured to contain and protect a small personal alarm or remote control device in a way that permits prompt activation thereof to summon assistance that cannot be provided autonomously. The adornment device will either have the look of jewelry, or comprise a modular casing to which one or more decorative elements can be attached. Thus, the present invention is configured to disguise and/or improve the aesthetic look of an otherwise visually unattractive personal alarm or remote control device, so that its user would be more likely to wear it on a regular basis, and perhaps even while sleeping, leading to enhanced personal safety and well-being. When the present invention comprises modular construction and multiple readily-exchangeable decorative elements are employed by a user to vary the visible appearance of the hard protective case which houses an associated personal alarm or remote control device, the likelihood of habitual/daily use is even further supported and promoted. The hard case of the present invention comprises an inner case member and an outer case member (hereinafter respectively referred to as "inner member" and "outer member") that are in sliding relation to one another, and the present invention may also comprise a connected cord or chain that maintains a close association of the inner and outer members even when they are in an unassembled condition. An activation button access opening in each member is aligned with one in the other member for prompt and easy access of the person wearing it to the activation button on the personal alarm or remote control device housed therein. When the casing is contemplated for use with more than one size or style of personal alarm or remote control device, one or more resilient spacers may be used within the inner member, and at least one is typically placed in contact with the top of the alarm/remote to secure it in a fixed position against the outer member so as to allow prompt and easy access by a user to the activation button of the alarm/remote, any time it is needed. Also, to prevent improper assembly of the inner and outer member, so that their two openings will always be aligned for successful and effective user access to the activation button of the alarm/remote housed therebetween, the inner and outer members comprise complementary laterally asymmetrical keyed configurations. Although one larger vertically-elongated access opening each is preferred through the outer and inner members of the present invention, as shown in the accompanying illustrations, should the personal alarm or remote control device associated with the present invention have additional activation buttons relating to more than one electronic feature, such as but not limited to a light or a 'panic' button, multiple smaller access openings could instead be provided. In addition, the outer member of the present invention may optionally have an associated rotatable flap or cover that protects one or more sheet pockets sized to hold photos, user identification, and/or medical information including but not limited to known conditions, allergies, health insurance, and emergency contacts. Although not critical, it is preferred for sheet pockets to be made of transparent or translucent materials. The remote control device or personal alarm with which the present invention is associated may include, but is not limited to, medical summoning devices, medical monitoring devices, key chain alarms, personal alarms, garage door openers, remote keyless entry keychain fobs, LED lights, encrypted pass code generators, and any other small portable electronic device capable of enhancing the safety of its user while being worn or carried by the user, associated with the user's clothing (such as in the form of a brooch or pin, but not limited thereto), or associated with a fashion accessory or other object maintained close-at-hand to the user.

2. Description of the Related Art

The aging population worldwide is seeking ways in which to provide autonomous/independent enhancement of its personal safety. As a result, medical summoning devices and medical monitoring devices are among the many portable electronic devices easily carried by a user that are now more commonly employed. Other electrical or electronic devices frequently carried by a user may also contribute to enhanced personal safety, including personal alarms that can be activated any time someone feels unsafe, or in need of medical assistance, to attract the attention of others and obtain needed help. Remote control and other portable devices that also help the aging population achieve a higher level of personal safety, include but are not limited to garage door openers which allow people in a motor vehicle to quickly enter a garage while remaining within the safety of the motor vehicle and then promptly close the garage door behind them before exiting the motor vehicle, key chain alarms that instantly attract attention and/or summon help for its user, remote keyless entry keychain fobs that typically allow faster entry into a home or motor vehicle (day or night) than a metal key, key chain flashlights or LED lights that help people more easily locate a keypad or keyhole in a door lock for faster entry into a home or business building, and encrypted pass code generators that limit unauthorized entry. Therefore, instead of needing to rely on a relative, friend, or neighbor to accompany them on trips away from home, or periodically check on them when they are home to make certain that they have not fallen, become incapacitated, otherwise have some other need for assistance that they cannot fulfill themselves, the personal alarm or remote control device can be promptly employed by its user to open a garage door or summon a specifically needed type of assistance. However for such devices to work, they must be habitually carried by the user, located directly on the user, on attached clothing, or otherwise placed close-at-hand to a user, with 24-hour a day, seven days a week carriage providing the most enhancement, even while the user is sleeping. Not surprisingly, the most common reason for personal alarms and remote control devices not to work, is that the person failed to wear it at the time it was needed, and in addition the device was not otherwise within its user's reach. Furthermore, among the reasons frequently cited by users for not wearing a personal alarm or remote control device is that they are visually unattractive and have the general appearance of a military dog tag or a simple geometric appearance that is instantly recognizable as a "badge" of reduced autonomy. To overcome this problem with prior art personal alarms and remote control devices, the present invention disguises them with a hard protective case of modular construction capable of providing personal alarms and remote control devices with a jewelry-like, fashionable, and/or otherwise pleasing, aesthetic look that encourages its user to habitually wear it and thus keep it close by at all times to provide its user with the best opportunity for being able to promptly summon assistance, whenever needed. Although not considered a part of the present invention and not shown in the accompanying illustrations, multiple interchangeable decorative elements that are attachable to the outer casing member of the present invention (by snap-fit or other commonly known connection means) are also preferred for promoting habitual use of a personal alarm or compact remote control device that provides a safety-enhancing advantage for its user. The two inventions thought to be the closest to the present invention are disclosed in U.S. Pat. No. 5,388,691 to White (1995) and U.S. Pre-Grant Publication 2002/0175096 to Linihan (2002). However, neither of these inventions has the sliding arrangement of inner and outer member that is provided by the present invention, nor all of the features and advantages of the present invention.

BRIEF SUMMARY OF THE INVENTION

It is the primary object of the present invention to provide a piece of jewelry or a jewelry-like adornment device that can house a personal alarm or remote control device so that the look of the personal alarm or remote control device is sufficiently enhanced aesthetically to encourage its user to wear it or otherwise keep it close-at-hand in a location allowing immediate and convenient user access to the activation button of the alarm/remote at all times, even while its user is sleeping. It is also an object of the present invention to provide an adornment device that in addition to decorative enhancement further provides a protective function for an associated personal alarm or remote control device. To encourage habitual/daily use, it is a further object of the present invention to provide an adornment device made from lightweight and low maintenance materials that are not too heavy to interfere with user comfort when worn and do not require regular polishing, cleaning, or other lengthy process to maintain it in a readily usable condition. It is also an object of this invention to provide an adornment device configured for prompt and easy installation of a personal alarm or remote control device between its inner and outer members, and secure positioning of the alarm/remote once it is installed. Another object of this invention to provide an adornment device configured for prompt and/or easy removal or exchange of an associated personal alarm or remote control device for a replacement. It is further an object of the present invention to provide an adornment device with a configuration that has no sharp edges or other features capable of posing a physical danger to its user. It is also an object of the present invention to provide an adornment device that does not create radio frequency interference with an associated personal alarm or remote control device or any other electrical/electronic devices in close proximity to its user. It is a further object of the present invention to provide an adornment device that provides only one option for assembly, so that the personal alarm or remote control device always becomes supported in a manner that would allow immediate use of its activation button or buttons. It is also an object of the present invention to provide an adornment device with casing components that always maintain a close association with one another, even when in an unassembled condition, so that temporary misplacement of one component cannot occur and regular/habitual use is thus simplified and encouraged. Another object of this invention to provide an adornment device configured with means for storing photos, user identification information, up-to-date medical information, and/or other information needed by the user or a person coming to the assistance of the user. These and other objects, features, and advantages of this invention will become more apparent upon reading the following specification in conjunction with the accompanying illustrations.

The present invention, when properly made and used, provides a protective casing in jewelry or jewelry-like form that can house a remote control device or personal alarm, such as but not limited to medical summoning devices, medical monitoring devices, key chain alarms, personal alarms, garage door openers, remote keyless entry keychain fobs, LED lights, and encrypted pass code generators. The hard case/housing can be decorative in and of itself, or it can be configured in modular form to provide a base to which independent decorative elements can be interchangeably attached to make the remote control device or personal alarm more appealing to its user by increasing the variety of appearances potentially provided, and thereby promoting increased usage that results in the enhanced personal safety of its user. It is optional for the present invention to be configured for more than one size or model of remote/alarm, and it is also optional for the outer member of the present invention to have a rotatable flap or cover configured to protect sheet pockets used to store photos and information helpful to the user or a person coming to the user's assistance. However, the adornment device of the present invention will always comprise a hard case that provides a protective function for an associated alarm/remote, while also providing the means to achieve a pleasing or otherwise aesthetically enhanced look, alone or in combination with one or more independently attached decorative elements (temporarily or permanently affixed). When lightweight and low maintenance materials are used for present invention construction, users are more likely to habitually wear them and their safety becomes enhanced. Easy installation of a personal alarm or remote control device within the present invention, and exchange of one alarm/remote for another, also makes it more likely for users to habitually wear a device having features most likely to provide the best safety-enhancing advantage, as differing activities are conducted during a day or as the user's health improves or deteriorates during an illness or surgical recovery period. In addition, when no sharp corners are included as a part of the present invention, when it has no other feature or structure that could pose a physical danger to its user, and also when an alarm/remote is easy to install and there is only one non-confusing and non-frustrating way to assemble the present invention, and further when it does not pose a risk of radio frequency interference with any electronic devices (self-contained or nearby), users gain confidence in the present invention adornment device and become more comfortable about keeping an alarm/remote close-at-hand, resulting in personal safety enhancement. Also, it is preferred that the present invention comprise a cord or chain to maintain an association of its two sliding parts to one another, even in an unassembled condition. This prevents inadvertent loss or misplacement of one sliding member from the other, which again enhances the opportunity for more habitual/daily present invention use and enhanced personal safety of its user.

The description herein provides preferred embodiments of the present invention but should not be construed as limiting its scope. For example, variations in the dimensions and perimeter configuration its outer member as long as it remains configured for a sliding relation with its associated inner member, the type or length of chain/cord used with the inner or outer members as long as the chain/cord allows prompt and easy disassembly of the inner and outer members to install or replace an alarm/remote, the configuration of the asymmetrical keyed means that provides one-way sliding association of the inner and outer members with one another, the amount and type of resilient material used within the inner member as a spacer to secure alarm/remote positioning during use, the configuration of a cover attached to the outer member and assembled inner and whether outer members are adapted or adaptable as a necklace, brooch, pin, bracelet, or other type of jewelry or jewelry-like device, other than those shown and described herein, may be incorporated into the present invention. Thus, the scope of the present invention should be determined by the appended claims and their legal equivalents, rather than being limited to the examples given.

DETAILED DESCRIPTION OF THE INVENTION

Figure 1:
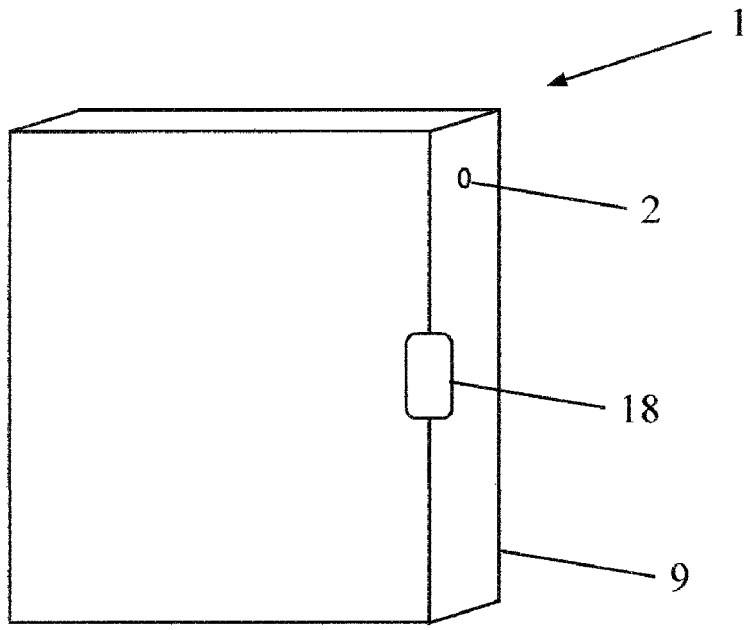
FIG. 1 is a front view of a first preferred embodiment of the present invention in the form of a visibly unadorned and modular-looking hard casing configured to contain a personal alarm or remote control device, with its outer member showing one small drill hole through its exposed side and an optional clasp that can be used to attach/secure an independent decorative element so that it at least partially covers the outer member to visually enhance its aesthetic appearance.
Figure 2:
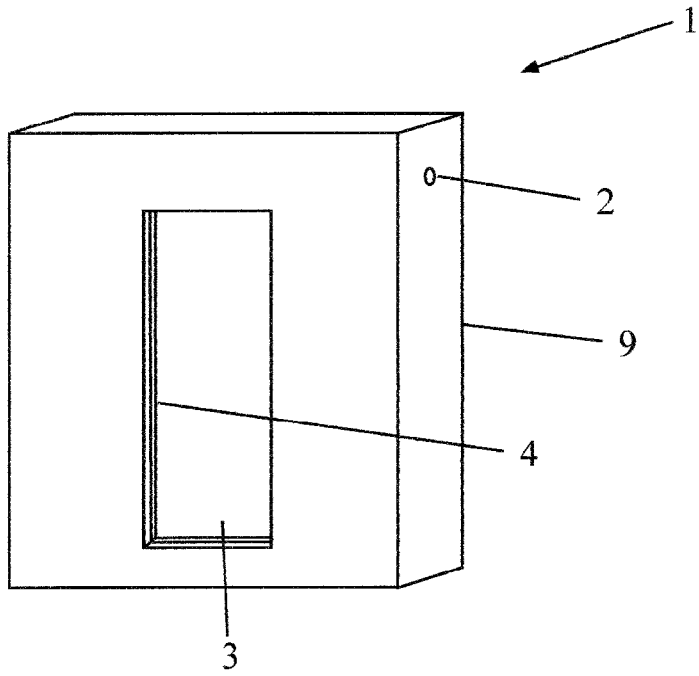
FIG. 2 is a back view of the first preferred embodiment of the present invention with outer and inner members that are in sliding association with one another, which also have aligned access openings configured to expose the activation button of an associated personal alarm or remote control device for convenient and easy access by a person wearing the present invention or otherwise maintaining it close-at-hand.
Figure 6:
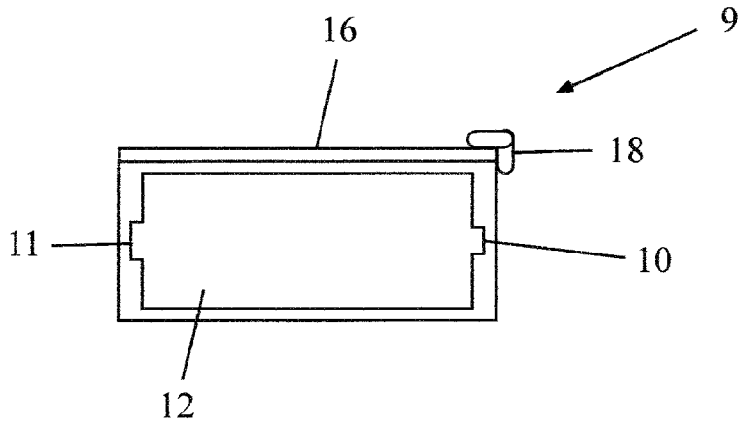
FIG. 6 is a bottom view of a second preferred embodiment of an outer member usable as a part of the present invention, that shows a bottom opening and opposed keyed slide openings formed into its interior side surfaces, with the left keyed slide opening being larger than the opposed keyed slide opening on the right to provide one-way association with the inner member, an optional rotatable flap or cover adjacent to the exterior surface of the outer member, and an optional clasp that can be used to secure the rotatable flap or cover, and/or attach/secure an independent decorative element.
Figure 7:
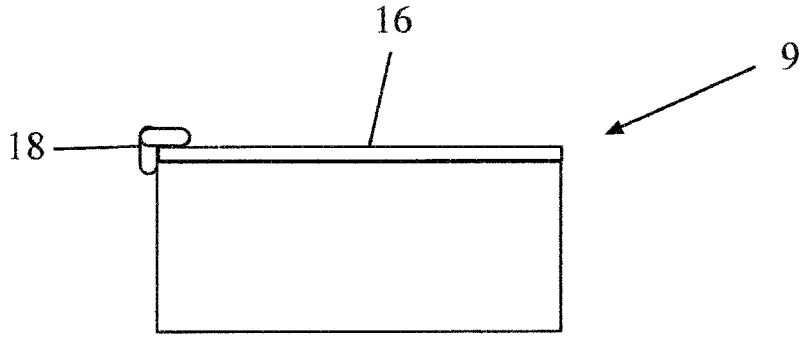
FIG. 7 is a top view of the outer member shown in FIG. 6, which discloses a solid top surface, an optional rotatable flap or cover adjacent to the exterior surface of the outer member, and an optional clasp that can be used to secure the rotatable flap or cover, and/or attach or secure an independent decorative element.
Figure 8:
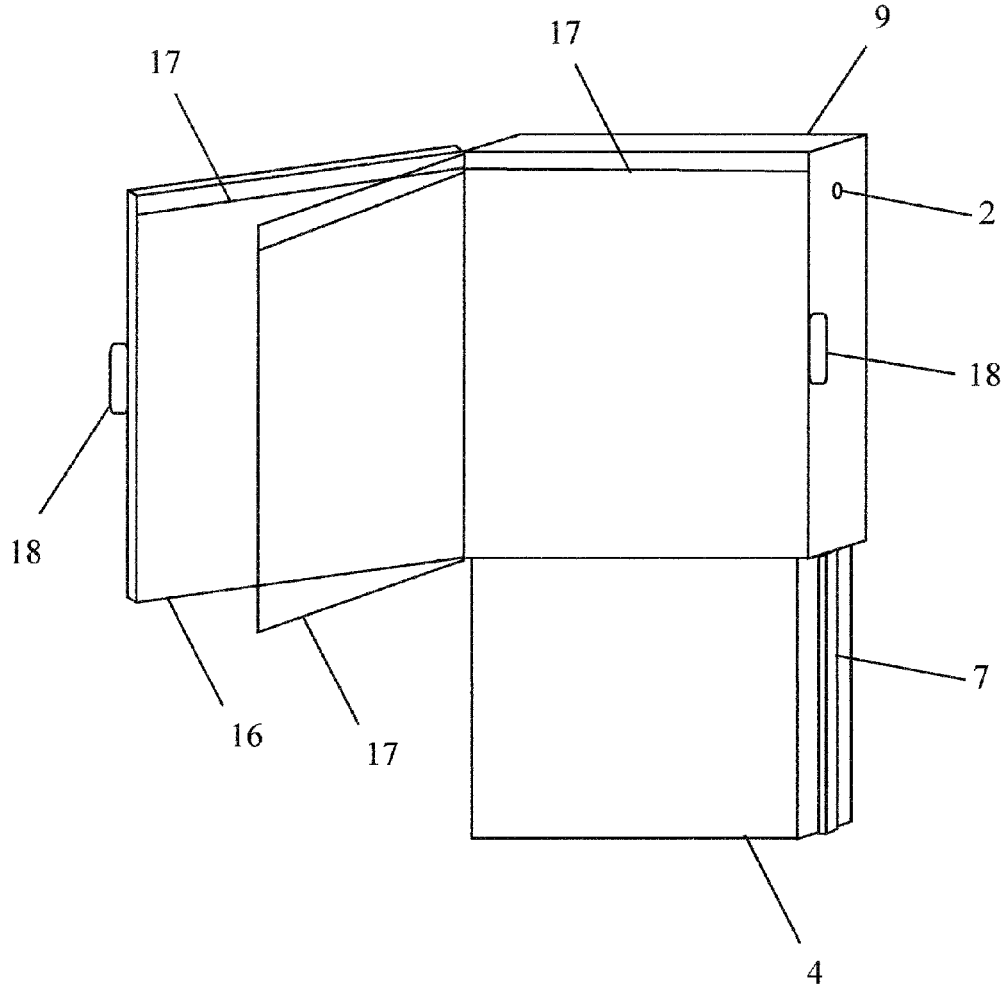
FIG. 8 is a partially exploded front view of the outer member shown in FIG. 6, which reveals the inner member being partially withdrawn in a downwardly direction from the outer member positioned above it, the smaller keyed slide on the exterior side of the inner member visible to a viewer, the outer member having a small drill hole through its side surface in a position near its solid top surface, an optional rotatable flap or cover in an opened position that is rotated away from the exterior front surface of the outer member, three clear sheet pockets positioned between the flap/cover and the outer member's exterior front surface, and an optional clasp that can be used to secure the rotatable flap or cover, and/or attach or otherwise secure an independent decorative element in front of the outer member.

A first preferred embodiment 1 of the present invention is shown in FIGS. 1 and 2 and comprises two main components (inner casing member 4 and outer casing member 9, hereinafter referred to as 'inner member 4' and 'outer member 9'), which are in sliding relation with one another and together form a hard casing for protecting and maintaining a personal alarm or remote control device close-at-hand to a user. Complementary, but asymmetrical, keyed means promote proper assembly of the inner member 4 and outer member 9 into the needed casing configuration that aligns the activation button access openings 3 of inner and outer members (4 and 9) with one another. While the present invention can be configured as any type of jewelry or jewelry-like device (including but not limited to a necklace, bracelet, brooch, or pin), as it is shown in FIG. 10, first preferred embodiment 1 is configured with a cord or chain 13 in the form of a necklace. Although the exterior surface of the outer member 9 shown in FIGS. 1-2 and 6-10 is visibly unadorned and has a simple geometric perimeter for ease of illustration, it is contemplated for outer member 9 in the preferred embodiments of the present invention to also have many decorative configurations that disguise and/or otherwise enhance the appearance of an installed personal alarm or remote control device (identified in FIG. 10 by the number 14), and/or provide any aesthetically appealing surface decoration or decorations (including but not limited to those comprising color enhancement, etching, filigree, cloisonné, and/or inlaid gems or rhinestones). Also, it is preferred that the present invention has a means of maintaining a close association of its inner member 4 and outer member 9, such as but not limited to the cord or chain 13 shown in FIG. 10, so that even when the personal alarm or remote control device 14 is being installed or removed, and the inner member 4 and the outer member 9 are in an unassembled condition, one of the sliding members (inner 4 or outer 9) will not become inadvertently misplaced and bring on user abandonment of habitual/daily use of alarm/remote 14. Furthermore, to adapt inner member 4 and outer member 9 for use with multiple sizes of alarms/remotes 14, one or more resilient spacers 15 can be used between the top of the associated alarm/remote 14 (while it is positioned within inner member 4) and the interior top surface of outer member 9. Gravity will force the associated alarm/remote 14 and the spacer or spacers 15 downwardly into inner member 4 (a spacer 15 made from non-tacky putty is easily installed and repositioned according to need), with the spacer or spacers 15 fixing the associated alarm/remote 14 into a stable position for proper user operation of access button 19 when inner member 4 and outer member 9 are in a fully assembled condition. The combination of cord/chain 13 being connected through drill holes in both inner member 4 and outer member 9, and presence of resilient spacer or spacers 15, provide secure containment of alarm/remote 14 within assembled inner and outer members (4 and 9), whether alarm/remote 14 is taller than, the same height as, or shorter than its supporting inner member 4. When multiple sizes of alarms/remotes 14 are contemplated for use with a single present invention device, it is preferred for the activation button access openings 3 in inner member 4 and outer member 9 to have an enlarged configuration, such as but not limited to the large and vertically-elongated configuration shown in FIG. 10. In addition, it is contemplated for the present invention to optionally a capability of storing photos or information important to the user or a person providing assistance to the user. A rotatable flap or cover 16 is shown in FIGS. 6-8 for such purposes. FIG. 8 also shows three clear sheet pockets 17 between flap/cover 16 and the exterior surface of outer member 9 that can be used for storing medical and other information that is needed to be held close-at-hand to the present invention user. Although sheet pockets 17 are shown to be transparent in the accompanying illustrations, and transparency or translucency is preferred, being made from "clear" materials is not a critical feature of sheet pockets 17. FIG. 8 also shows a clasp 18 that can be used to secure flap/cover 16 against the exterior surface of outer member 9. Although not shown in greater detail in the accompanying illustrations, it is contemplated within the scope of the present invention for clasp 18 to be rigidly fixed in position during its use or to have at least one movable component. Also, the configuration of clasp 18 shown in FIG. 8 should not be considered as limiting to the scope of the present invention. In addition, although not shown, it is also contemplated for other closure means to be used for flap/cover 16, such as but not limited to a strap, a hook-and-loop closure, or a decorative stretchable sleeve. In addition or in the alternative, clasp 18 can be used to secure one or more independent decorative elements (not shown) over all or part of the front surface (and optionally the exterior side surfaces) of outer member 9. When the present invention comprises modular or adaptable construction, and multiple readily-exchangeable decorative elements (not shown) can be alternatively made available for use therewith to vary the visible appearance of its hard protective case housing an alarm/remote 14, the opportunity for habitual/daily use of the alarm/remote 14 is even further supported and the user's safety becomes enhanced. As an alternative to the use of clasp 18 for decorative element attachment/association with outer member 9, although not shown herein, other commonly known attachment/association means for decorative elements are also contemplated, including but not limited to direct clip-on attachment over all or part of the front of outer member 9, a snap-lock type of attachment directly to outer member 9, hook-and-loop fasteners, resilient and/or decorative stretchable sleeves, adhesives, bonding agents, integrated devices provided by the original equipment manufacturer (OEM) of the associated personal alarm or remote control device, and other integrated OEM fastening means. Since the present invention is contemplated for containing a personal alarm or other remote control device 14 during its use, and in addition may also support the weight of a decorative element (not shown), as well as the weight of any attachment means for securing the decorative element to outer member 9, it is preferred (but not limited thereto) for the maximum length and width dimensions of outer member 9 to be approximately two inches when employed as part of a necklace, so that the present invention does not become uncomfortably heavy when worn around a neck (which could reduce a desire for habitual/daily use thereof). A variety of materials can be used for manufacture of inner member 4 and outer member 9 and any decorative elements (not shown) employed to make inner member 4 and outer member 9 resemble jewelry (and/or otherwise enhance their aesthetic appeal in a jewelry-like manner). Furthermore, although the present invention is configured to facilitate a decorative purpose, it must be also designed to ensure a user's safety. Thus, inner member 4 and outer member 9, as well as any detachable decorative elements (not shown) employed, should be made from durable and non-corroding materials that have no sharp edges or any other feature or composition that may pose a risk of injury to the user. The durable materials should also require little or no routine maintenance, such as but not limited to regular polishing, cleaning, or other lengthy process needed to maintain it in a readily usable and aesthetically pleasing condition.

As for technical applicability, it is envisioned that the most likely group of people to purchase the present invention are disabled and older people who already employ, or are about ready to purchase, a personal alarm or other remote control system or device (14 or other small electronic device). They typically would be purchasing it for themselves, but may also purchase it for others. Then, once they have the alarm/remote 14 installed contained in a modular present invention adornment device, they can purchase any number of interchangeable and replaceable decorative elements (not shown), and alternatively employ such elements for aesthetic enhancement of outer member 9 that can change its appearance daily, thereby encouraging habitual/daily use of an alarm/remote 14 to provide enhanced personal safety. While older women are prime potential customers for buying the present invention in amulet or jewelry form for themselves and/or their friends, men who believe that a personal alarm 14 represents a "badge" of non-autonomy, may also want to employ the present invention to disguise it. Children and grandchildren of older women are also potential customers. In the alternative, although not shown, a present invention adornment device may comprise a campaign-promoting design and/or message with a fastening mechanism configured for attachment to user clothing or an accessory. The campaign-promoting design and/or message of the present invention would create an independent connection to alarm/remote 14 in the mind of a user, thereby providing additional incentive for the user to habitually wear the present invention with its installed alarm/remote 14. One such campaign-promoting design and/or message displayed could include photos of children and/or grandchildren mounted against the front surface of outer member 9 (or a cover 16 depending from outer member 9). In considering the marketability of the present invention, one should not underestimate the concern with personal appearance that has been conditioned during the twentieth century in western civilization women. Even when homebound, such women typically want to look fashionable and attractive, and they would be more willing to wear a decorative device superimposed over any personal alarm that was considered to be unattractive or otherwise portraying a message of non-autonomy. As people age, personal alarms and remote control devices make it more likely that they can stay in their own homes. However, aging does not diminish the desire of consumers for products with aesthetical appearance and designs, as well as good quality materials and manufacture.

In addition to after-market conversion of existing jewelry to accommodate personal alarms and remote control devices (14 and other small electronic devices), and OEM embodiments, there is also a secondary market for the present invention, as it offers an opportunity to well-known jewelry designers who make a good portion of their income by branding less expensive product lines to expand sales into the in-home market. If the present invention was configured to incorporate a two-part design separable into a decorative element that is attachable to a standardized modular casing design, manufacturers of personal alarms and remote control devices (14 and other) and independent jewelry designers could individually create present invention components, each doing what they do best.

As previously mentioned, safety issues are of primary concern in all phases of present invention construction. The use of durable, non-corroding, and reliable materials, in addition to a simple modular design and reinforced construction, allows the present invention to function acceptably in critical situations involving personal safety, which can literally be a matter of life and death to its user. It is also important that materials selected do not create radio frequency interference with the installed alarm/remote 14, or with other electrical/electronic devices (not shown) in close proximity to its user. A few examples of features and advantages that are preferably incorporated as a part of the present invention include, but are not limited thereto, 1) any chain (see cord/chain 13 in FIG. 10) or other material used to support inner member 4 and outer member 9 as part of a necklace with an installed alarm/remote 14 must be strong and securely fastened to inner member 4 and/or outer member 9 so that it does not inadvertently come separated from inner member 4 and outer member 9 during use; 2) the fastening means by which decorative elements are secured to outer member (9 or other equivalent structure) must not under any circumstances allow the fastening mechanism or any associated decorative element (detachable or not) to interfere with easy user access to the activation button/means 19 of the personal alarm or remote control device (14 or other small electronic device capable of enhancing personal safety when used); 3) decorative elements (not shown) must be fabricated in a secure fashion and without any sharp points or other features that could be potentially injurious to a user; 4) components of the present invention, including any chains 13 or other similar components, must be at least as durable and functional as those used to make the personal alarm or remote control device (14 or other) used with the present invention. In all considerations regarding the manufacture of the present invention and life-saving electronic devices/equipment, the primary goal is to configure both so as to promote habitual/daily wearing of the life-saving electronic equipment protected and supported by the present invention.

FIGS. 1 and 2 show a first preferred embodiment 1 of a present invention device for protecting a personal alarm or remote control device and maintaining it in a position on or close-at-hand to a user. FIG. 1 is a front view of first preferred embodiment 1 in the form of an unadorned hard casing (made from inner member 4 and outer member 9), with outer member 9 showing one small drill hole 2 on its exposed side and an optional clasp 18 near one edge that can be used to secure a rotatable flap or cover (see number 16 in FIG. 8), or attach/secure a decorative element (not show) over at least a portion of outer member 9. In contrast, FIG. 2 is a back view of first preferred embodiment 1 showing outer member 9 and inner member 4 in sliding association with one another and activation button access openings 3 in each that are configured to expose the activation button 19 of the personal alarm or remote control device 14 for easy access to it by a person wearing the present invention or otherwise having the present invention close-at-hand. FIG. 2 shows the opening 3 in inner member 4 substantially aligned with the opening 3 in outer member 9. Furthermore, both access openings 3 appear to be similar in size and configuration, which is not critical and may vary according to manufacturing considerations and the type of alarm/remote 14 contemplated for installation within inner member 4 and outer member 9. Also, positioning access openings 3 through the back surface of inner member 4 and outer member 9 may not be the disadvantage that it might first seem. While access openings 3 through the back surface of inner member 4 and outer member 9 keep an installed alarm/remote 14 hidden from view and provide a decorative advantage (particularly when it is worn around the neck), a functional advantage is also gained in that a user reaching for the casing created by inner member 4 and outer member 9 without twisting the cord or chain 13 suspending it, will automatically place a thumb in contact with activation button 19, which typically larger than one's fingers and able to assure sufficient coverage of button 19 for prompt activation thereof. The perimeter configuration of outer member 9 in FIGS. 1 and 2 is modular and unadorned, for ease of illustration. However, it must be kept in mind that the configuration of outer member 9 can be different from that shown in FIGS. 1 and 2, and any decorative surface enhancement may also be used, such as but not limited to added color via paint or glazes, etching, filigree, cloisonné, and gemstone or rhinestone attachment. Furthermore, although FIGS. 1 and 2 show small drill holes 2 adjacent to the solid top surface of outer member 9, and preferred positioning of small drill holes 2, the relative size, positioning, and configuration of drill holes 2 are not critical and may be different from that shown. In addition, the clasp 18 used as a part of the present invention can also have a size, positioning, and configuration different from that shown in FIG. 1. The number of clasps 18 employed with outer member 9 may also be more than the one shown in FIG. 1. Additionally, although in FIG. 2 the size, number, and configuration of the activation button access openings 3 in inner member 4 and outer member 9 appear to be very similar to one another, each access opening 3 only needs to be minimally sized to provide easy and convenient user access to the activation button 19 of the personal alarm or remote control device 14 associated with the present invention. Also, although in preferred embodiment 1 (as shown in FIGS. 1 and 2) outer member 9 appears to have angular corners, no sharp corners that are capable of causing injury to a user would be present. Although it is contemplated for a decorative cord or chain 13 (see FIG. 10) to be used through drill holes 2 in inner member 4 and outer member 9 and provide support for them when preferred embodiment 1 is employed as a necklace, cord or chain 13 can also be used to maintain a close association of inner member 4 to outer member 9 when they are disassembled to prevent inadvertent loss of one of them that could lead to discontinued daily use of alarm/remote 14 by the user and condition of diminished personal safety. However, when outer member 9 becomes part of a bracelet, brooch, pin, or other type of jewelry, cord or chain 13 could become optional depending upon the other type of structure needed and being provided.

Figure 3:
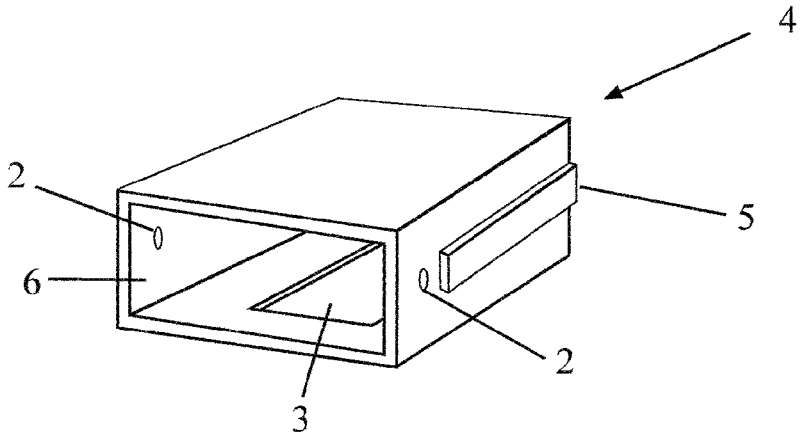
FIG. 3 is a perspective view from the top of an inner member usable as a part of the first preferred embodiment of the present invention, and which shows opposed small drill holes on the opposite sides thereof, a large keyed slide adjacent to the small drill hole on the exterior side of the inner member visible to a viewer, and a vertically-elongated access opening configured to expose the activation button of an associated personal alarm or remote control device installed therein.
Figure 4:
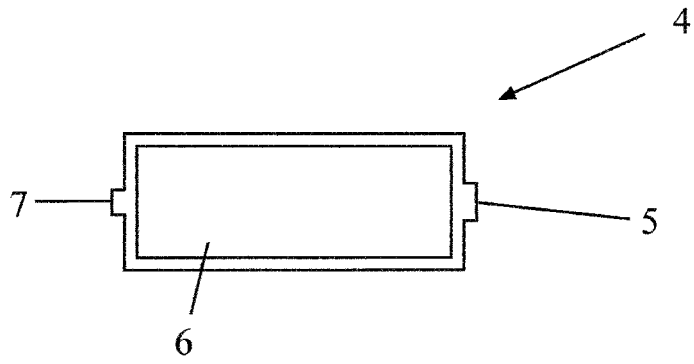
FIG. 4 is a top view of the inner member shown in FIG. 3, which reveals a top opening and opposed keyed slides on its exterior side surfaces, with the right keyed slide being larger than the left keyed slide for one-way positioning within the outer member and proper alignment of the vertically-elongated access openings configured to expose the activation button of an associated personal alarm or remote control device installed therein.
Figure 5:
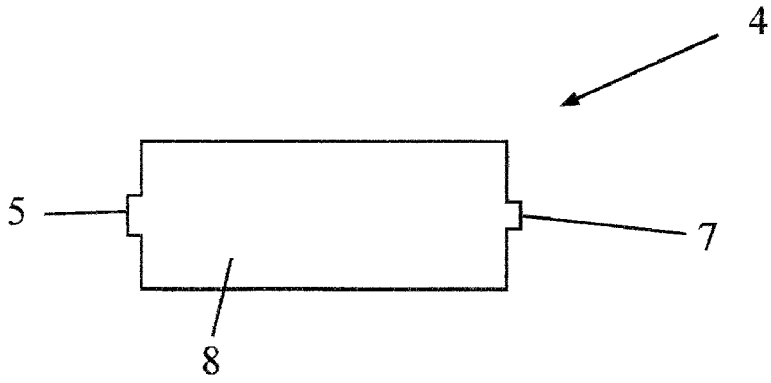
FIG. 5 is a bottom view of the inner member shown in FIG. 3, which discloses a solid bottom surface and opposed keyed slides on its exterior side surfaces, with the larger keyed slide shown positioned on the left.

FIGS. 3-5 show the inner member 4 contemplated for use as a part of first preferred embodiment 1. FIG. 3 is a perspective view from the top of inner member 4 and shows opposed small drill holes 2 on the opposite sides thereof, a large keyed slide 5 adjacent to the small drill hole 2 on the exterior side of inner member 4 visible to a viewer, and an access opening 3 configured to expose the activation button 19 of an associated personal alarm or remote control device 14. In contrast, FIG. 4 is a top view of inner member 4 show a top opening 6 in inner member 4 and asymmetrically configured opposed keyed slides (5 and 7) on its exterior side surfaces, with the right keyed slide 5 being larger than the left keyed slide 7 to provide one-way positioning of inner member 4 within outer member 9 and proper alignment of their respective access openings 3 every time inner member 4 and outer member 9 undergo assembly. Thus, the one-way sliding orientation for inner member 4 and outer member 9 provides assurance that the activation button 19 of an associated personal alarm or remote control device 14 will always be properly positioned through both access openings 3 for user activation when needed to obtain safety-enhancing assistance. FIG. 5 is a bottom view of inner member 4 and shows a solid bottom surface 8 of inner member 4 and opposed keyed slides (5 and 7) on its exterior side surfaces, with the larger keyed slide 5 being on the left. Although the opposed keyed slides (5 and 7) in inner member 4 do not have to employ the configuration thereof specifically shown in FIGS. 3-5, it is critical that they are complementary in configuration to the keyed slide openings 10 and 11 shown in outer member 9 in FIG. 6. Also, keyed slides 5 and 7, as well as the complementary keyed slide openings 10 and 11, may be reversed from that shown in FIGS. 3-5, with keyed slides 5 and 7 associated with outer member 9 and the complementary keyed slide openings 10 and 11 associated with inner member 4. In addition, it is also considered to be within the scope of the present invention for keyed slides 5 and 7 and the complementary keyed slide openings 10 and 11 to be in other positions on inner member 4 and outer member 9, instead of only being centered on the side surfaces thereof (as shown in FIGS. 3-5), including on the front and back interior surfaces of outer member 9 and the front and back exterior surfaces of inner member 4. It is also preferred that opposed keyed slides (5 and 7) and their complementary keyed slide openings 10 and 11 provide some asymmetry to prevent improper orientation of inner member 4 within outer member 9, wherein the two access openings 3 do not become aligned. Furthermore, when asymmetrical keyed slides 5 and 7 are used with inner member 4, they can have reverse positioning from that shown in FIGS. 3-5, depending upon manufacturer, user preference, and/or other consideration.

FIGS. 6-8 show a second preferred embodiment of the present invention with optional attachments to the exterior surface of its outer member 9. FIG. 6 is a bottom view of the outer member 9 in the second preferred embodiment of the present invention, and shows a bottom opening 12 and opposed keyed slide openings 10 and 11 formed into its interior side surfaces, with the left keyed slide opening 11 being larger than the opposed keyed slide opening 10 for one-way sliding association with inner member 4, an optional rotatable flap or cover 16 adjacent to the exterior surface of outer member 9, and an optional clasp 18 that can be used to secure the rotatable flap or cover 16 in a fixed position during use, or perhaps attach/secure a decorative element (not shown) to outer member 9, or both. The relative sizes of outer member 9, opposed keyed slide openings 10 and 11, and the optional clasp 18 are not critical and may be different from that shown, as long as they can work in concert to provide their needed functions. Also, the configuration in FIGS. 6-8 and positioning of clasp 18 are not critical, and the number of clasps 18 used for decorative or functional purpose may be different from that show in FIGS. 6-8. In addition, although only a general and simplistic representation of a rotatable flap or cover is shown in the accompanying illustrations, it is contemplated for any configuration of flap or cover 16, hinged or unhinged, to be within the scope of the present invention. FIG. 7 is a top view of outer member 9 in the second preferred embodiment of the present invention, and shows outer member 9 having a solid top surface, an optional rotatable flap or cover 16 adjacent to the front exterior surface of outer member 9, and an optional clasp 18 that can be used to secure the rotatable flap or cover 16, or attach/secure a decorative element (not shown) to outer member 9. FIG. 8 is a partially exploded front view of the second preferred embodiment of the present invention, that shows its inner member 4 partially withdrawn in a downwardly direction from the outer member 9 positioned above it, the smaller keyed slide 7 on the exterior side of inner member 4 visible to a viewer, outer member 9 having a small drill hole 2 through its side surface in a position near its solid top surface, an optional rotatable flap or cover 16 in an opened position that is rotated away from the exterior front surface of outer member 9, three clear sheet pockets 17 positioned between the flap/cover 16 and the exterior front surface of outer member 9, and an optional clasp 18 that can be used to secure the rotatable flap or cover 16 in close association with outer member 9, or attach/secure a decorative element (not shown) in front of the outer member 9 (over all or part of rotatable flap or cover 16. The size and number of sheet pockets 17 used is not critical, although it is preferred for sheet pockets 17 not to extend beyond protective flap/cover 16 to best preserve their integrity and prevent premature deterioration. Optionally, sheet pockets 17 may be configured and sized to hold photos, user identification, and/or information relating to known medical conditions or allergies, health insurance, emergency contacts, and/or other information helpful to a person answering a user's call for assistance. Furthermore, although clear sheet pockets 17 are preferred, sheet pockets may also be transparent, translucent, clear colored, and opaque. Also, optional rotatable flap or cover 16 may have reverse positioning from that shown in FIGS. 3-5

(and open from left-to-right, instead of right-to-left), depending upon manufacturer or user preference.

Figure 9:
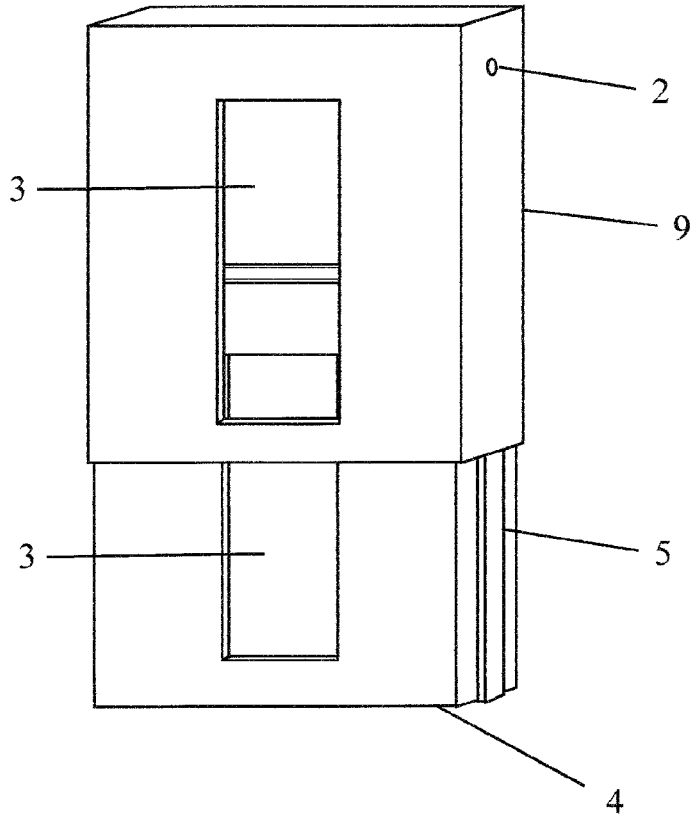
FIG. 9 is a partially exploded back view of the first preferred embodiment of the present invention, which shows the inner member partially withdrawn in a downwardly direction from the outer member positioned above it, the respective vertically-elongated activation button access openings in the outer and inner members being only partially overlapping, the larger keyed slide associated with the exterior side of the inner member visible to a viewer, and the outer member having a small drill hole through its side surface in a position near its solid top surface.
Figure 10:
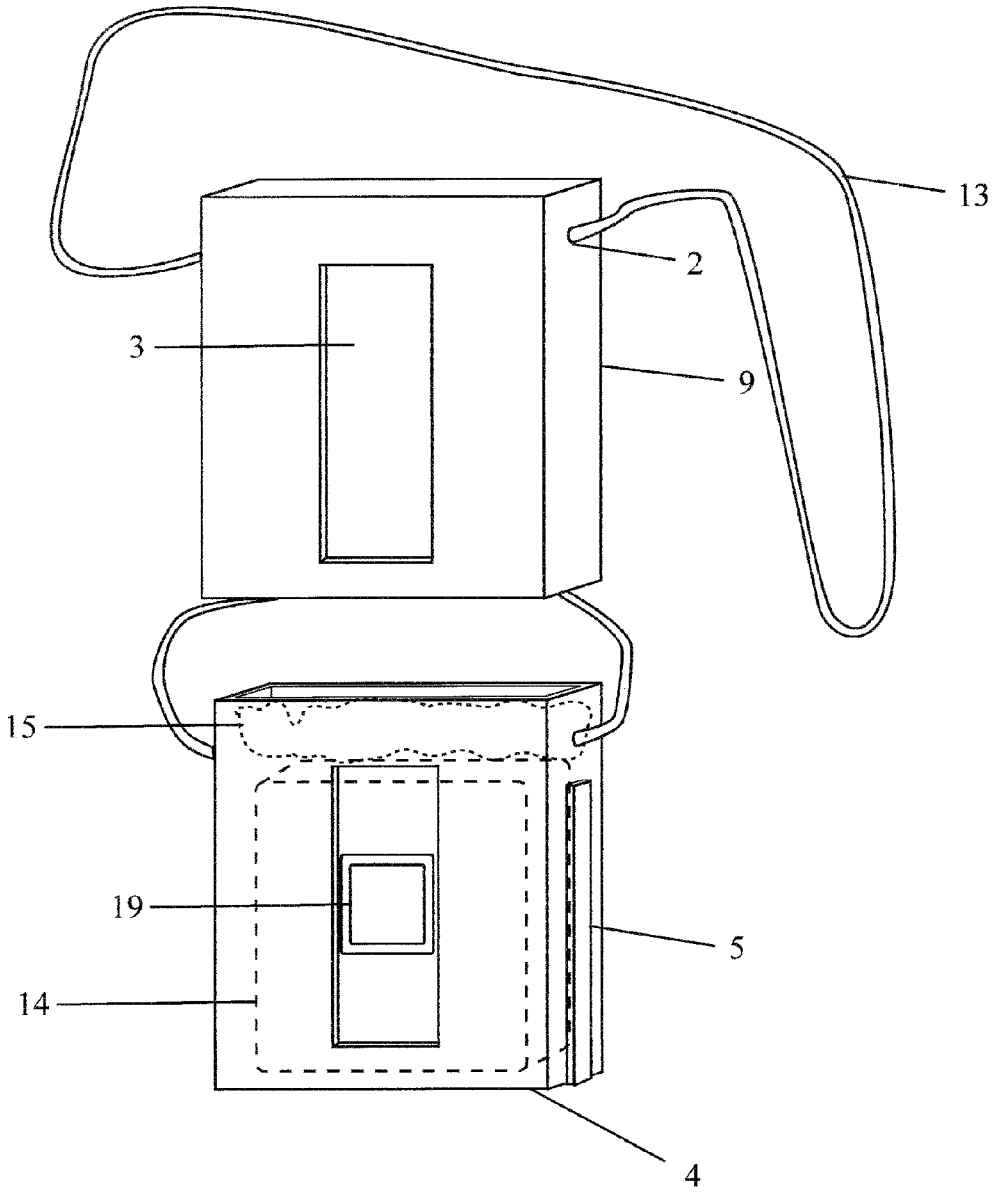
FIG. 10 is an exploded back view of the first preferred embodiment of the present invention in an unassembled condition, which shows the inner member completely withdrawn in a downwardly direction from the outer member positioned above it, the larger keyed slide on the exterior side surface of the inner member visible to a viewer, a representation of a cord or chain threaded through the small drill holes in the outer member and also extending through the small drill holes in the inner member, the respective activation button access openings in the outer and inner members both facing toward a viewer, a personal alarm or remote control device positioned within the inner member, the activation button of the alarm/remote exposed through the access opening in the inner member, and a position-fixing resilient spacer positioned within the inner member above the alarm/remote.

FIGS. 9 and 10 show first preferred embodiment 1 with inner member 4 at least partially separated from outer member 9. FIG. 9 is a partially exploded back view that shows inner member 4 partially withdrawn in a downwardly direction from its associated outer member 9, which is in a position above it. FIG. 9 also shows the respective activation button access openings 3 in outer member 9 and inner member 4 being only partially overlapping, the larger keyed slide 5 on the exterior side of inner member 4 visible to a viewer, and outer member 9 having a small drill hole 2 through its side surface in a position near its solid top surface. In contrast, FIG. 10 is an exploded back view of the first preferred embodiment 1 and shows inner member 4 fully withdrawn in a downwardly direction from the outer member 9 positioned above it, the larger keyed slide 5 on the exterior side of inner member 4 visible to a viewer, a cord or chain 13 (or other flexible/filamentous object) in a threaded position through the small drill holes 2 in outer member 9 and also threaded through the small drill holes 2 in inner member 4, the respective activation button access openings 3 in the outer member 9 and inner member 4 both facing rearward (and positioned for substantial alignment with one another after inner member 4 become inserted into outer member 9), a personal alarm or remote control device 14 positioned within inner member 4, the activation button 19 of the alarm/remote 14 exposed through the access opening 3 in inner member 4, and a resilient spacer 15 (such as but not limited to putty that is preferably non-tacky, foam, or a substantially cohesive and easy-to-handle quantity of resilient material or fiber) positioned within inner member 4 adjacent to alarm/remote 14. If preferred embodiment 1 is contemplated for holding an alarm/remote 14 having a height dimension greater than that of outer member 9, and the form of a necklace is used with cord or chain 13 inserted as shown in FIG. 10, then, when the exterior top surface of the associated alarm/remote 14 is in contact with the interior top surface of outer member 9, inner member 4 would not be fully hidden within outer member 9, in contrast to the assembly configuration shown in FIGS. 1 and 2. Thus, the configurations of inner member 4 and outer member 9 would be a contemplated configuration of the present invention, as long as the button 19 of personal alarm or remote control device 14 can remain fully accessible through the two access openings 3 in inner member 4 and outer member 9. This type of size adaptability available as a result of the sliding relation of inner member 4 and outer member 9 in the present invention is particularly useful should a personal alarm user change companies and now have a replacement personal alarm device that is larger or smaller than the original one, or has a different perimeter configuration than the original. Such a benefit would also be advantageous when a person previously requiring a personal alarm experiences improved health and no longer need one, then a remote keyless entry key fob or other remote control device having a slightly different configuration or size than the personal alarm can now be effectively substituted for the personal alarm and continue to enhance the safety of its user, albeit in a different manner. Although surface decoration on outer member 9 and/or inner member 4 could directly provide aesthetic enhancement of preferred embodiment 1 when a portion of inner member 4 remains in view, in the alternative, a decorative element (not shown) could permanently or detachably depend from the front surface of outer member 9 and hide any exposed portions of inner member 4 that are not considered by the user to be aesthetically pleasing. The relative sizes of outer member 9, keyed slide 5, access openings 3, resilient spacer or spacers 15 used, and cord/chain 13 may be different from that shown, as long as each successfully fulfills their respective functions. Also, instead of one opening 3 each in inner member 4 and outer member 9, applications are contemplated where more than one opening 3 could also be used in inner member 4 or outer member 9. The remote control device or personal alarm 14 with which the present invention is associated may include, but is not limited to, medical summoning devices, medical monitoring devices, key chain alarms, personal alarms, garage door openers, remote keyless entry keychain fobs, LED lights, encrypted pass code generators, and any other portable electronic device capable of enhancing the safety of its user while being worn or carried by the user, associated with the user's clothing (such as in the form of a brooch or pin, but not limited thereto), or associated with a fashion accessory or other object maintained in close proximity to the user. Also, although not shown, if inner member 4 and outer member 9 are configured for use with more than one size of alarm/remote 14, an additional piece of resilient material (similar in composition and configuration to, or potentially different from, resilient spacer 15) can be placed behind alarm/remote 14 to position its activation button 19 where a user can easily access it to summon assistance. As a matter of clarity and ease of illustration, the configuration of outer member 9 has been kept simplistic and looks modular. However, it must be appreciated that a multiplicity of very intricate and jewelry-like designs are also a contemplated part of the present invention, even though not shown, such as those using gemstones or rhinestones, filigree, and/or cloisonné. A mounted photo, other image, or words may also be included as part of the decorative enhancement of outer member 9. In addition, any cord or chain 13 employed as a part of the present invention should be strong and durable. The ends of cord or chain 13 are each first inserted through a different one of the drill holes 2 in outer member 9, and then inserted through a different one of the drill holes 2 in inner member 4. Cord or chain 13 should then be secured against withdrawal/separation from inner member 4 (such as with knotted cord ends, but not limited thereto). Since the cord or chain 13 extends through at least one drill hole in both inner member 4 and outer member 9, when cord or chain 13 is hung around a user's neck, gravity causes the combined mass of inner member 4, outer member 9, and the associated alarm/remote 14 to apply a downwardly directed force on cord or chain 13 that causes it to become taut, thus causing further resistance against inadvertent separation of inner member 4 from outer member 9 when the present invention is worn. This added security is a benefit to those who might otherwise worry about the potential loss of a personal alarm or other remote control device 14 when it is supported and/or suspended by another structure. Furthermore, although not shown in the accompanying illustrations, decorative markings may also be present on the back of outer member 9 and/or flap/cover 16, which may include, but are not limited to a mounted photo, other image, or words. Also, as noted above, outer member 9 may be incorporated into the form of a bracelet, brooch, pin, or other form of jewelry that would keep alarm/remote 14 close-at-hand to a user. Although not shown, it is considered within the scope of the present invention for hook-and-loop fasteners, snap-fit configurations, a resilient decorative sleeve, and other commonly known attachment means to be employed to secure flap/cover 16 and/or outer member 9 into their usable positions. It is also contemplated for the present invention to be made from lightweight and low maintenance materials that do not require regular polishing, cleaning, or other lengthy process to maintain it in a readily usable condition, as this might cause reduced incentive for the user to wear or display it with clothing or accessories. The present invention should also be made from materials that do not create radio frequency interference with any electrical/electronic device in close proximity to its user (including alarm/remote 14).

While the present invention has been disclosed herein in its preferred forms, it will be apparent to those skilled in the art that many modifications, additions, and/or deletions, can be made therein without departing from the spirit and scope of the present invention and its equivalents, as set forth in the following claims.

What is claimed is:

1. An adornment device for securing and protecting a personal alarm or remote control device and maintaining its activation button in close proximity to a user to enhance the user's personal safety, said adornment device comprising:

an outer member with a closed top surface, a bottom opening, and a decoratively enhanced appearance;

an inner member with a closed bottom surface and a top opening that is slidably movable within said outer member between a fully assembled position that forms a protective casing around a personal alarm or remote control device inserted at least in part within said, inner member, and an unassembled position that permits removal of the personal alarm or remote control device from said inner member;

said inner member and said outer member each having at least one activation button access opening therethrough, with said access openings in positions that allow said at least one activation button access opening of said inner member to become aligned with said at least one activation button access opening of said outer member when said inner member is in said fully assembled position; and said inner member and said outer member each having complementary keyed means adapted for sliding movement of said inner member within said outer member only in an orientation that allows both of said access openings to become aligned, said complementary keyed means further comprising a larger keyed slide and a smaller keyed slide in opposed positions from one another, wherein when a user places a personal alarm or remote control device with an activation button within said inner member so that the personal alarm or remote control device becomes inserted at least in part within said inner member and its activation button is easily accessible to the user through said access opening in said inner member, and the user then movably slides said inner member within said outer member into a fully assembled position that forms a protective casing around the personal alarm or remote control device, said complementary keyed means allows positioning of said inner member with respect to said outer member only so that both of said access openings become aligned and the activation button of the personal alarm or remote control device remains easily accessible to the user.

2. The adornment device of claim 1 wherein said larger keyed slide and said smaller keyed slide outwardly depend from said inner member.

3. The adornment device of claim 2 wherein said keyed slides extend from said closed bottom surface of said inner member toward said top opening, and said inner member further comprises a drill hole therethrough between each of said keyed slides and said top opening.

4. The adornment device of claim 1 wherein said activation button access openings in said inner member and said outer member are similar in size.

5. The adornment device of claim 1 wherein said inner member and said outer member are adapted for use with more than one size of personal alarm or remote control device.

6. The adornment device of claim 5 further comprising a resilient spacer positioned within said inner member when it contains the personal alarm or remote control device and is in said fully assembled position.

7. The adornment device of claim 1 wherein said inner member and said outer member each further comprises at least one drill hole.

8. The adornment device of claim 7 further comprising a cord and wherein said cord extends through said at least one drill hole in said inner member and said at least one drill hole in said outer member so as to maintain a close association of said inner member and said outer member when said inner member is in said unassembled position.

9. The adornment device of claim 7 further comprising a chain and wherein said chain extends through said at least one drill hole in said inner member and said at least one drill hole in said outer member so as to maintain a close association of said inner member and said outer member when said inner member is in said unassembled position.

10. The adornment device of claim 1 further comprising at least one clasp associated with said outer member.

11. The adornment device of claim 10 wherein said outer member further comprises a Movable cover, and said at least one clasp is configured to maintain a close association of said cover with said outer member.

12. The adornment device of claim 11 further comprising at least one sheet pocket positioned between said cover and said outer member.

13. The adornment device of claim 10 wherein said clasp is configured for association of decorative elements with said outer member.

14. A method of enhancing the personal safety of the user of a personal alarm or remote control device, that protects the personal alarm or remote control device, secures the personal alarm or remote control device in close proximity to the user, and maintains its activation button close-at-hand to the user, said method comprising the steps of:

providing said adornment device of claim 1 and a personal alarm or remote control device having an activation button;

placing said personal alarm or remote control device at least in part within said inner member and so that said activation button is easily accessible through said at least one access opening in said inner member;

using said complementary keyed means to place said inner member in proper orientation with said outer member for slidable movement of said inner member into said outer member, and sliding said inner member into said outer member until said inner member is in said fully assembled position and said activation button is also exposed through said at least one access opening in said outer member, wherein a protective casing is formed by said inner member and said outer member around said personal alarm or remote control device inserted at least in part within said inner member, that the user may keep close-at-hand to enhance personal safety.

15. The method of claim 14 wherein said larger keyed slide and said smaller keyed slide outwardly depend from said inner member.

16. The method of claim 15 wherein said keyed slides extend from said closed bottom surface of said inner member toward said top opening, and said inner member further comprises a drill hole therethrough between each of said keyed slides and said top opening.

17. The method of claim 16 wherein said outer member further comprises opposing drill holes therethrough, and further comprising a step of providing a cord or chain configured for extending through said drill holes, a step of extending said cord or chain through said drill holes in said inner member and said outer member, and a further step of securing said cord or chain to prevent said cord or chain from withdrawing from said drill holes in said inner member to maintain a close association of said inner member and said outer member when said inner member is in said unassembled position.

18. The method of claim 14 wherein said activation button access openings in said inner member and said outer member are similar in size.

19. The method of claim 14 further comprising a step of providing of a resilient spacer and a step of positioning said resilient spacer within said inner member when it contains said personal alarm or remote control device and is in said fully assembled position.

20. The method of claim 14 further comprising a step of providing a cover, at least one sheet pocket, and at least one clasp, and also comprising a step of associating said cover, said at least one sheet pocket, and said at least one clasp with said outer member.

* * * * *